US008490275B2

(12) United States Patent
Kott

(10) Patent No.: US 8,490,275 B2
(45) Date of Patent: Jul. 23, 2013

(54) METHOD FOR PRESSING AND FIXING RIVETS IN COMPONENT HOLES

(75) Inventor: Horst Kott, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 590 days.

(21) Appl. No.: 12/526,425

(22) PCT Filed: Feb. 15, 2008

(86) PCT No.: PCT/EP2008/051865

§ 371 (c)(1),
(2), (4) Date: Jan. 6, 2010

(87) PCT Pub. No.: WO2008/099007

PCT Pub. Date: Aug. 21, 2008

(65) Prior Publication Data

US 2010/0170078 A1 Jul. 8, 2010

(30) Foreign Application Priority Data

Feb. 15, 2007 (DE) ..... 10 2007 007 496

(51) Int. Cl.
*B21J 15/02* (2006.01)
*B21J 15/10* (2006.01)

(52) U.S. Cl.
USPC ..... 29/524.1; 29/525.05; 29/525.06; 29/243.53

(58) Field of Classification Search
USPC ..... 29/897.2, 524.1, 525.05, 525.06, 29/34 B, 243.5, 243.53, 243.54
See application file for complete search history.

(56) References Cited

U.S. PATENT DOCUMENTS 3,201,967 A * 8/1965 Balamuth et al. ..... 72/359
3,224,086 A * 12/1965 Balamuth ..... 29/525
3,292,413 A * 12/1966 Falcioni ..... 72/377
3,483,611 A 12/1969 Balamuth et al.
3,747,382 A * 7/1973 McMaster et al. ..... 72/56
3,754,310 A * 8/1973 Shea ..... 29/25.42

(Continued)

FOREIGN PATENT DOCUMENTS

DE 19729368 A1 1/1999
WO WO 2008/099007 A1 8/2008

OTHER PUBLICATIONS

German Office Action from DE 10 2007 007 496.6 dated Sep. 24, 2007.

(Continued)

*Primary Examiner* — Jermie Cozart
(74) *Attorney, Agent, or Firm* — Jenkins, Wilson, Taylor & Hunt, P.A.

(57) ABSTRACT

The invention relates to a vibrating rivet tool for pressing and fixing rivets in component holes in component of aircraft. The vibrating rivet tool comprises a rivet receptacle and a drive unit for producing a high static pressing force. According to the invention, the static pressing force is superimposed by a mechanical vibration, of which the amplitude acts substantially in the direction of a longitudinal axis of the rivet. As a result, the force necessary to press and fix the rivet in a component hole is reduced in such a way that the overall size and mass of the vibrating rivet tool according to the invention are smaller/lower in comparison with conventional rivet tools. Due to the small overall size and low weight, the vibrating rivet tool can more easily be integrated in automated riveting processes.

9 Claims, 1 Drawing Sheet

U.S. PATENT DOCUMENTS

| | | | | |
|---|---|---|---|---|
| 4,864,713 | A * | 9/1989 | Roberts et al. | 29/524.1 |
| 4,908,928 | A * | 3/1990 | Mazurik et al. | 29/525.06 |
| 4,998,943 | A * | 3/1991 | Roberts et al. | 29/432.2 |
| 5,027,490 | A | 7/1991 | Roberts et al. | |
| 5,060,362 | A * | 10/1991 | Birke et al. | 29/525.06 |
| 6,098,260 | A * | 8/2000 | Sarh | 29/243.53 |
| 6,357,101 | B1 * | 3/2002 | Sarh et al. | 29/407.09 |
| 7,698,797 | B2 * | 4/2010 | Hetrick et al. | 29/505 |
| 2006/0168792 | A1 | 8/2006 | Reatherford et al. | |

OTHER PUBLICATIONS

International Search Report and Written Opinion for PCT/EP2008/051865 dated Jun. 16, 2008.

European Office Action for Application Serial No. 08 716 872.0 dated Jul. 24, 2012.

* cited by examiner

METHOD FOR PRESSING AND FIXING RIVETS IN COMPONENT HOLES

CROSS-REFERENCE TO RELATED APPLICATIONS

This application claims the benefit of German Patent Application No. 10 2007 007 496.6, filed Feb. 15, 2007, the entire enclosure of which is herein incorporated by reference.

TECHNICAL FIELD

The invention relates to a vibrating rivet tool for pressing and fixing rivets in component holes in component, in particular in aircraft component, with a rivet receptacle and a drive unit, the drive unit producing a static pressing force in the direction of a longitudinal axis of a rivet.

BACKGROUND

Known embodiments of vibrating rivet tools and rivet hammers in aircraft construction press the rivet into the rivet hole using considerable mechanical forces acting, in particular, in the axial direction of the rivet. In this case, the rivet tool must apply a force of up to a tonne (approx. 10 kN). Due to the considerable force that is required to press the rivet in, the rivet tools must be configured so as to be correspondingly large and heavy. Rivet machines weighing up to a tonne are therefore required in the case of automated riveting for connecting component.

A more advanced automisation of riveting processes, for example by using conventional industrial articulated arm robots so as to also allow component to be automatically riveted in working positions that are not easily accessible, is thereby impeded.

A device is known from U.S. Pat. No. 5,027,490 for inserting rivets into superimposed workpieces. The complex and heavy device comprises, inter alia, a drive unit and a vibration unit. A static force for pressing the rivets is first applied by way of a drive unit whilst the vibration unit reduces mechanical stresses in the workpieces after the rivets have actually been fixed in position.

DE 197 29 368 A1 also relates to a device and a method for mechanically joining sheet metal plates, profiles and/or multiple-sheet metal connections. In the case of this rivet device, the rivet is driven into the workpieces via high-frequency impacts with a relatively low impact energy, the die being resiliently dampingly mounted as an abutment for the tappet. The spring stiffness and/or damping of the die adapt depending on the resonant frequency of the sheet metal plates to be joined. A separate generator for producing high-frequency vibrations is not provided.

A device is further known from U.S. Pat. No. 3,483,611 for joining two component together using force and ultrasound. A first component made, for example, of a textile nylon fabric is disc-shaped, whilst the second component to be connected thereto can be made of metal or plastics material and comprises small prongs, points or spikes pointing upwards. Both components are bonded together in the device similar to a conventional moulding press. The prongs of the lower second component penetrate the upper first component by the simultaneous use of force and ultrasound ranging between 1 kHz and 100 kHz and a vibration amplitude of up to 0.635 mm, the prongs plasticised at least in part by force and ultrasound being reformed so as to be mushroom-shaped. This device does not provide a conventional rivet connection between two sheet metal plates.

SUMMARY

The object of the invention is to provide a rivet tool which, with the same riveting capacity, is considerably lighter in comparison with conventional riveting hammers.

The object is achieved with a rivet tool according to the presently-disclosed subject matter.

Since at least one vibratory generator for producing mechanical vibration is provided, an amplitude of said mechanical vibration superimposing the static pressing force, rivets can be inserted or pressed into a rivet hole using a relatively low pressing force by way of the vibrating rivet tool according to the invention. The weight of the vibrating rivet tool can therefore be considerably reduced in comparison with conventional riveting hammers. As a result of the reduced weight of the vibrating rivet tool, riveting processes can be automated which, previously, could not be automated due to the heavy weight of the riveting hammers. The amplitude of the mechanical vibration can act on the longitudinal axis of the rivet at any desired angle of between 0° and 90°. This angle may optionally be variable during operation and this can be achieved, for example, by way of swiveling vibratory generators. The at least one vibratory generator preferably works within the ultrasound range, in a frequency range between 10 Hz and 1 MHz.

An advantageous embodiment provides for the amplitude of the mechanical vibration to extend parallel and/or transversely to the longitudinal axis of the rivet. As a result, the vibrating rivet tool is constructionally simpler and more compact. Preferably, the amplitude of the mechanical vibration extends parallel to the longitudinal axis of the rivet.

An advantageous configuration of the vibrating rivet tool provides for a frequency of the mechanical vibration to be adjusted, preferably continuously. The frequency of the mechanical vibration can therefore, for example, be adjusted in such a way that it corresponds to the frequencies of the component to be connected. As a result of the resonance effect thus achieved, the pressing force required for pressing can be further reduced.

In a further advantageous development of the vibrating rivet tool, the strength of the mechanical vibration, in particular the amplitude thereof, can be adjusted, preferably continuously. The effect of the vibration superimposing the mechanical pressing force can therefore be varied depending on the material properties of the component to be joined.

According to a further advantageous configuration, it is provided for the frequency of the mechanical vibration to be variable within a frequency range of up to 10 kHz with a drive frequency of up to 1 kHz. Mechanical vibration which even more efficiently supports the pressing of the rivet into a component hole can therefore be produced. If the (basic) frequency of the at least one vibratory generator is 100 kHz, a frequency range or frequency interval of 10 kHz means that said mechanical vibration of 100 kHz can be varied within a frequency range between 95 kHz and 105 kHz (=100 kHz±5 kHz) with a drive frequency ("wobble frequency") of, for example, 1 kHz. The frequency of the at least one vibratory generator varies, particularly preferably, around a resonance point.

Furthermore, the invention relates to a method for pressing and fixing rivets in component holes in aircraft components. Since a static pressing force produced by a drive unit acts on a longitudinal axis of the rivet, a mechanical vibration produced by at least one vibratory generator superimposing the static pressing force so as to facilitate the process of pressing the rivet into the component holes, component can be riveted more quickly.

An advantageous development of the method provides for a vibration vector of the mechanical vibration to act substantially parallel and/or transversely to the longitudinal axis of the rivet. As a result, the necessary pressing force is reduced to a greater degree.

Further advantageous configurations of the rivet tool and method for the use thereof are disclosed in other claims.

DETAILED DESCRIPTION OF THE DRAWINGS

Figure 1:
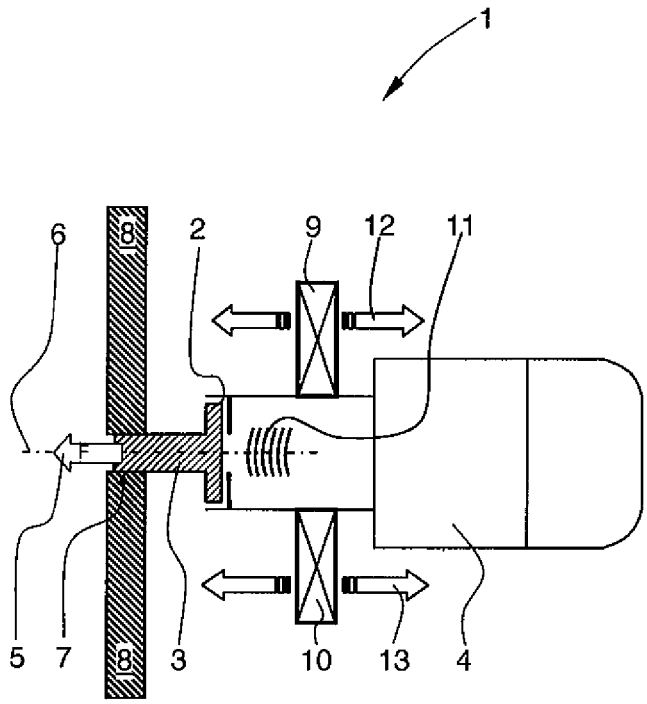
FIG. 1 shows a first variation of the vibrating rivet tool.

FIG. 1 shows a first variation of the vibrating rivet tool.

A vibrating rivet tool 1 comprises, inter alia, a rivet receptacle 2 for receiving a rivet 3 and a drive unit 4. The drive unit 4 produces a considerable mechanical, purely static pressing force 5 which acts substantially parallel to a longitudinal axis 6 of a rivet. In order to facilitate the process of pressing the rivet 3 into a component hole 7 in a component 8, the vibratory generators 9, 10 for producing a mechanical vibration 11 are arranged in the region of the rivet receptacle 2, the amplitude of which vibration superimposes the static pressing force 5. In the embodiment shown in FIG. 1, the vibratory generators 9, 10 are arranged diametrically opposite one another in the region of the rivet receptacle 2. In principle, it is also possible to arrange a vibratory generator 9 or 10 at only one side of the rivet receptacle 2. Furthermore, more than two vibratory generators may be provided which are preferably arranged equidistant from one another peripherally in the region of the rivet receptacle 2 and/or in the region of the drive unit 4.

A mechanical vibration 11 is produced by the two vibratory generators 9, 10, the amplitude of which mechanical vibration extends substantially parallel to the double-headed arrows 12, 13. The process of pressing and therefore fixing the rivet 3 in the component hole 7 of the component 8 is facilitated by the mechanical vibration 11 superimposing the pressing force 5. As a result, in comparison to conventional rivet tools and riveting hammers, a considerably reduced pressing force 5 is sufficient so the vibrating rivet tool 1 according to the invention can be configured so as to be constructionally lighter with a comparable or higher riveting capacity. Due to the lower deadweight in comparison with conventional rivet heads, the vibrating rivet tool 1 according to the invention can, for example, be used more easily in conventional industrial articulated arm robots for automated riveting of component.

The frequency and/or amplitude of the mechanical vibration 11 produced by the vibratory generators 9, 10 can be adjusted, preferably continuously, by way of a control and regulating unit (not shown). If the frequency in the mechanical vibration 11 is adjusted in such a way that it corresponds substantially to a resonance frequency of the component to be riveted, the pressing force 5 can be further reduced. As a result of a variation in the amplitude of the mechanical vibration 11, it is possible to increase the strength of the mechanical vibration 11 superimposing the pressing force 5 so as to facilitate the process of pressing the rivet 3.

The frequency of the mechanical vibration 11 produced by the two vibratory generators 9, 10 is preferably between 10 Hz and 1 MHz and is preferably within the ultrasound range. In a variation, the mechanical vibration 11 can be varied within a frequency interval of up to 10 kHz. In this case, the drive frequency with which the mechanical vibration 11 is altered is preferably up to 1 kHz ("wobble frequency"). As a result, the effect of the mechanical vibration 11 of facilitating the pressing process increases further.

The amplitude of the mechanical vibration 11 may, in a variation to the illustration in FIG. 1, also act on the rivet receptacle 2 or the rivet 3 transversely to the longitudinal axis 6 of the rivet instead of longitudinally. Furthermore, it is possible for the amplitude of the mechanical vibration 11 to enclose a desired angle between 0° and 90° to the longitudinal axis 6 of the rivet. Moreover, the vibratory generators 9, 10 are pivotally arranged in such a way that, when the vibrating rivet device is in use, the spatial orientation of the vibrating vector of the superimposed mechanical vibration can be adjusted in relation to the longitudinal axis 6 of the rivet. The mechanical vibration 11 emitted by the two vibratory generators 9, 10 may be produced with piezo electric elements, with correspondingly activated electromagnets, or pneumatic and/or hydraulic vibratory generators. The mechanical pressing force 5 (pressing force F) produced by the drive unit 4 may, for example, be generated by electric, electromagnetic, hydraulic or pneumatic means or by a combination of said drive types.

Figure 2:
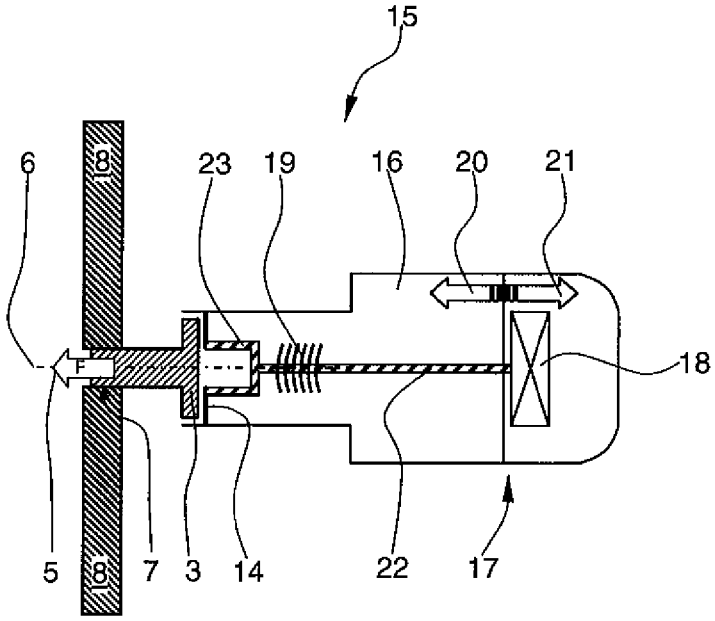
FIG. 2 shows a second variation of the vibrating rivet tool, the same constructional elements have the same reference numerals.

FIG. 2 shows a variation of a vibrating rivet tool.

The rivet 3 is received in a rivet receptacle 14 of a vibrating rivet tool 15 and is pressed and fixed in the component hole 7 of the component 8 by way of the pressing force 5 which acts along the longitudinal axis 6 of the rivet. In turn, a drive unit 16 produces the pressing force 5. In contrast to the first variation of the vibrating rivet tool, a vibratory generator 18 for producing the mechanical vibration 19 is arranged in a rear housing region 17 of the vibrating rivet tool 15, the amplitude of which mechanical vibration acts in the direction of the arrows 20, 21 substantially parallel to the longitudinal axis 6 of the rivet so as to support the process of pressing the rivet. The mechanical vibration 19 generated by the vibratory generator 18 is transferred to the rivet receptacle 14 by a tappet 22. The tappet 22 comprises, in the region of the rivet receptacle 14, an end piece 23 which is bell-shaped or cylindrically hollow. The end piece 23 of the tappet 22 may, in a variation to the illustration in FIG. 2, also be fork-shaped with at least two or more prongs, which are each supported on the rivet receptacle 14.

The advantage of the variation according to FIG. 2 is on the other hand that the vibratory generator 18 in the rear region of the housing of the vibrating rivet tool 15 can be integrated, resulting in the rivet receptacle 14 being configured in a more slender manner so the vibrating rivet tool 15 can also be used when the positions of the rivets are not easily accessible, in particular, for riveting component in confined installation areas. On the other hand, the configuration according to FIG. 2 only requires one vibratory generator 18 but still achieves a high degree of symmetry, that is to say the vibration 19 acts substantially directly on and parallel to the longitudinal axis 6 of the rivet.

The vibrating rivet tool 1, 15 according to the invention enables a significantly reduced pressing force 5 to be used in comparison with previously known embodiments of riveting hammers due to the mechanical vibration 11, 19 superimposing the static pressing force 5. As a result, the vibrating rivet tool 1, 15 can be configured so as to be smaller so new areas of application, in particular in the field of automated riveting processes with the increased use of robotics, can be developed. In addition, riveting frequency and capacity can be increased.

LIST OF REFERENCE NUMBERS

1 vibrating rivet tool
2 rivet receptacle
3 rivet
4 drive unit
5 pressing force (F)
6 longitudinal axis of a rivet
7 component hole
8 component
9 vibratory generator
10 vibratory generator
11 mechanical vibration
12 double-headed arrow
13 double-headed arrow
14 rivet receptacle
15 vibrating rivet tool
16 drive unit
17 rear housing region
18 vibratory generator
19 mechanical vibration
20 arrow
21 arrow
22 tappet
23 end piece

The invention claimed is:

1. A method for pressing and fixing rivets in component holes of a component of an aircraft with a vibrating rivet tool, wherein the vibrating rivet tool comprises a rivet receptacle and a drive unit;

wherein at least one vibratory generator is configured for producing a mechanical vibration; and wherein a static pressing force produced by the drive unit acts on a longitudinal axis of the rivet, a mechanical vibration produced by the at least one vibratory generator superimposing the static pressing force so as to facilitate the process of pressing the rivets into the component holes.

2. The method according to claim 1, wherein the amplitude of the mechanical vibration acts parallel and/or transversely to the longitudinal axis of the rivet.

3. The method according to claim 1, wherein the amplitude of the mechanical vibration comprises an angle between 0° and 90° to the longitudinal axis of the rivet.

4. The method according to claim 1, wherein at least one of a frequency of the mechanical vibration and an amplitude value of the mechanical vibration is adjusted.

5. The method according to claim 1, wherein at least one of a frequency of the mechanical vibration and an amplitude value of the mechanical vibration is continuously adjusted.

6. The method according to claim 1, wherein the frequency of the mechanical vibration between 10 Hz and 1 MHz is continuously provided.

7. The method according to claim 6, wherein the frequency of the mechanical vibration is varied within a frequency range of up to 10 kHz with a drive frequency of up to 1 kHz.

8. The method according to claim 1, wherein the mechanical vibration is generated by a piezo element as the at least one vibratory generator.

9. The method according to claim 1, wherein the mechanical vibration is generated by at least one vibratory generator which acts electromagnetically, pneumatically, and/or hydraulically.

* * * * *